United States Patent [19]

Raasch

[11] Patent Number: 4,672,802

[45] Date of Patent: Jun. 16, 1987

[54] METHOD AND DEVICE FOR STARTING THE SPINNING OF A THREAD IN AN OE-SPINNING DEVICE

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 759,425

[22] Filed: Jul. 25, 1985

[30] Foreign Application Priority Data

Jul. 25, 1984 [DE] Fed. Rep. of Germany ..... 3427356

[51] Int. Cl.[4] ..... D01H 15/00

[52] U.S. Cl. ..... 57/263

[58] Field of Search ..... 57/22, 261, 263

[56] References Cited

U.S. PATENT DOCUMENTS 3,924,393 12/1975 Stahlecker et al. ..... 57/263
3,962,855 6/1976 Stahlecker ..... 57/263
4,229,935 10/1980 Wain ..... 57/22
4,246,749 1/1981 Mikulecky et al. ..... 57/263
4,476,671 10/1984 Rohner et al. ..... 57/22 X
4,492,076 1/1985 Romic et al. ..... 57/22
4,494,368 1/1985 Mima ..... 57/263 X
4,539,803 9/1985 Ferro et al. ..... 57/263
4,549,392 10/1985 Kimura ..... 57/22

*Primary Examiner*—Donald Watkins
*Attorney, Agent, or Firm*—Herbert L. Lerner; Laurence A. Greenberg

[57] ABSTRACT

A method for starting the spinning of a thread in an OE-spinning device includes exposing a thread end to a gas current before starting spinning, subsequently conducting the thread end to a spinning element, collecting spinning fibers at the spinning element, and subsequently applying the spinning fibers to the thread end, and an apparatus for carrying out the method.

10 Claims, 7 Drawing Figures

METHOD AND DEVICE FOR STARTING THE SPINNING OF A THREAD IN AN OE-SPINNING DEVICE

The specification relates to a method and device for starting the spinning or joining of a thread in an OE-spinning device, including at least one spinning element which collects spinning fibers and applies them to the open end of the thread. For instance, rotor spinning devices or friction spinning devices may be considered as suitable OE-spinning devices. In rotor spinning devices, the rotor is the actual spinning element and in a friction spinning device, the spinning unit is formed by two friction elements, as a rule.

For starting the spinning or thread joining operation when starting up the spinning device and for starting the spinning or thread joining process after a thread break, the thread ending can be loosened by untwisting it or by grinding, so that the twist is removed and a fiber tuft is created. However, with mechanical means such as grinding or filing devices, the thread end frequently cannot be completely loosened. Furthermore, mechanical means are very costly.

It is accordingly an object of the invention to provide a method and device for starting the spinning of a thread in an OE-Spinning device, which overcomes the hereinafore-mentioned disadvantages of the heretofore-known devices of this general type, to create the conditions necessary to produce a good, durable, and even thread joint with an appearance similar to the thread and which has great tensile strength, and to thereby contribute to an increase in the quality of the open end spinning process.

With the foregoing and other objects in view there is provided, in accordance with the invention, a method for starting the spinning or joining of a thread in an OE-spinning device, which comprises exposing a thread end to a gas current before starting spinning or thread joining, subsequently conducting the thread end to a spinning element, collecting spinning fibers at the spinning element, and subsequently applying the spinning fibers to the open thread end.

In accordance with another feature of the invention, there is provided a method which comprises rotating or adding turbulence to the gas current.

For instance, a spiral rotational direction of the gas current can be directed against the direction of the twist of the thread, so that the twist at the end of the thread is loosened. A turbulent gas stream may also provide a more preferable rotational direction, which also should be directed against the twist in the thread. However, a turbulent gas stream could also change its direction in rapid sequence, so that a particular twist need not be taken into consideration. A thread which is provided with so-called "belly-bands" can also be loosened quite effectively by a turbulent gas stream which changes directions rapidly.

In accordance with an added feature of the invention, there is provided a device for starting the spinning or joining of a thread in an OE-spinning device having at least one spinning element for collecting spinning fibers and applying the spinning fibers to an open thread end, comprising an untwisting nozzle having a thread channel, means for sucking in, receiving and temporarily holding a thread end in the thread channel with a gas current before starting spinning or thread joining, and means for conducting the thread end to the spinning element.

The gas current can be taken from a compressed gas current which flows from the inlet side into the thread channel. However, it can also be caused by a suction gas current. In this case, the turbulence can be caused by vibrations and "dancing" of the thread end in the fiber channel.

In accordance with an additional feature of the invention, the sucking, receiving and holding means include at least one compressed gas conduction injection channel terminating in the thread channel. For example, the injection channel can be oriented obliquely against the longitudinal direction of the fiber channel. However, if the direction of the twist of the thread is also taken into account, in accordance with a further feature of the invention, the injection channel terminates in the thread channel with a tangentially directed component.

In order to shorten the time required for the preparation of the thread ending for starting the spinning or thread joining operation, and in order to intensify the preparation of the thread end, in accordance with again another feature of the invention, the untwisting nozzle includes an outflow or outlet end having bearing surfaces for spinning or hurling the thread end.

In accordance with again an additional feature of the invention, the bearing surfaces are ribs or webs extending into the thread channel.

In accordance with again a further feature of the invention, there is provided a device which includes a movable spinning starting or thread joining device on which the untwisting device is disposed.

Such a movable spinning starting or thread joining device can include all of the elements which are required to start the spinning or joining operation. In this case, it is not necessary to provide a separate untwisting nozzle at each spinning station or unit of a large spinning machine.

In accordance with a concomitant feature of the invention, the conducting means include a thread regulator movable in a given operating range from a thread severing location to the spinning element, the untwisting nozzle being disposed within the given operating range. When using a pivoting thread regulator, the untwisting nozzle can be disposed so close to the pivot path, that the thread end must be sucked into the untwisting nozzle when the thread regulator passes the untwisting nozzle with the end of the thread. In this way, the thread regulator is not necessarily interrupted or slowed down during its motion.

Other features which are considered as characteristic for the invention are set forth in the appended claims.

Although the invention is illustrated and described herein as embodied in a method and device for starting the spinning of a thread in an OE-spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
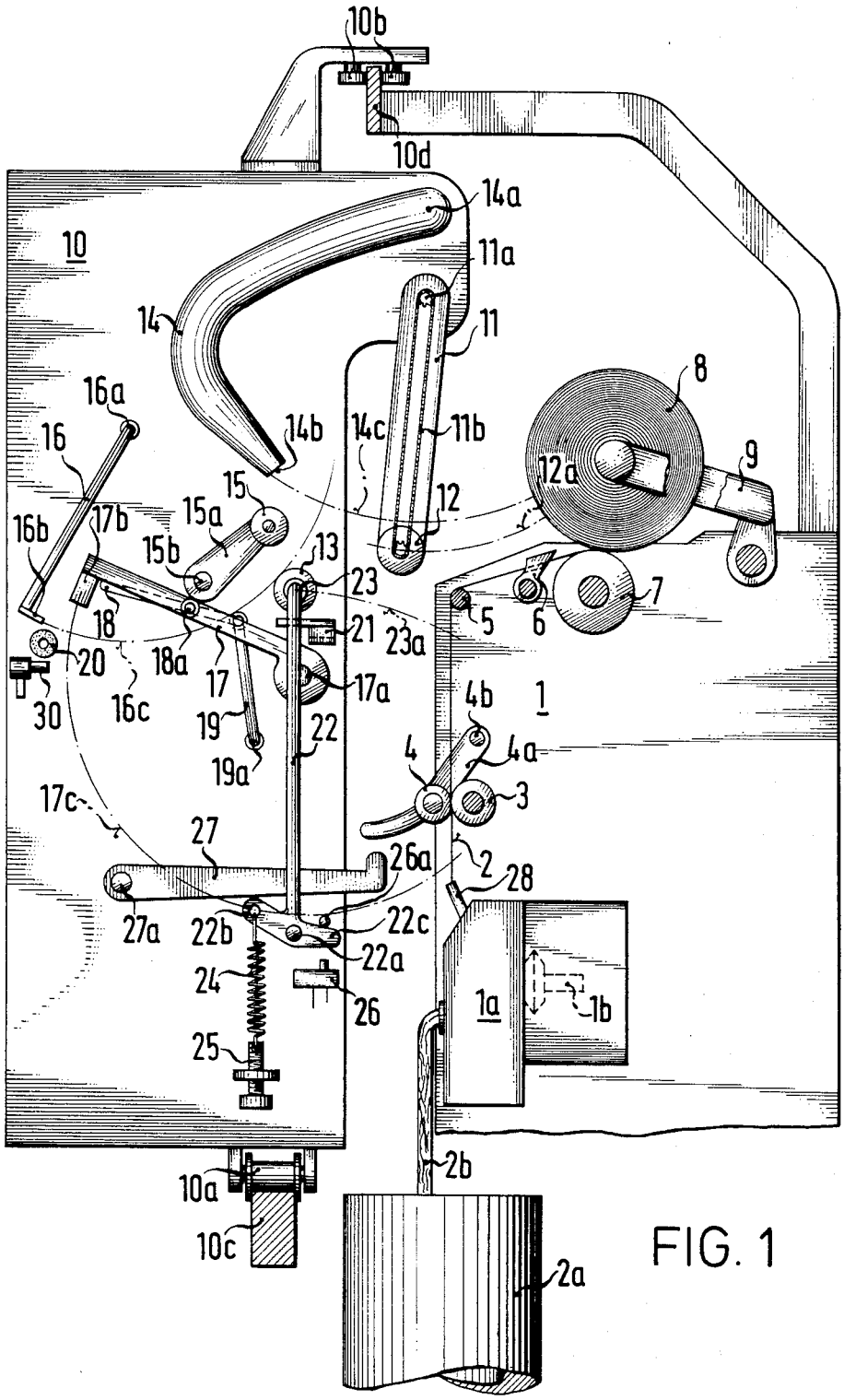
FIG. 1 is a fragmentary, diagrammatic, side-elevational view of a device for starting spinning or thread joining.

Referring now to the figures of the drawings in detail and first, particularly, to FIG. 1 thereof, there is seen an OE (open-end) spinning device 1 having a spinning element or organ 1*a* with a rotor 1*b*. During normal operation, a spun thread 2 is conducted through a thread withdrawal device, which is formed of a withdrawal roller 3 and a clamping roller 4. The thread 2 is pulled with constant speed from the spinning element 1*a* by the thread withdrawal device. From the roller 3, the thread 2 runs over a deflection rod 5, through a thread guide 6, and over a winding roller 7 onto a winding bobbin 8. The winding bobbin 8 is driven by friction with constant peripheral velocity. The winding bobbin 8 is supported in a winding frame 9.

Disposed in front of the spinning device 1 is a device 10 for starting the spinning operation or for thread joining, which is able to travel due to rollers 10*a*, 10*b* on rails 10*c*, 10*d*. This spinning starting or thread joining device has a drive arm 11 which can pivot about a pivot joint 11*a*. A drive roller 12 which is driven by a chain drive 11*b* and can swing along a circular arc 12*a*, is disposed at the end of the drive arm. The drive roller 12 can be driven in both directions of rotation by the chain drive 11*b*.

Furthermore, the spinning starting or thread joining device 10 has an additional thread withdrawal device, formed of a withdrawal roller 13 and a clamping roller 15. The clamping roller 15 is disposed at the end of a lever 15*a*, which can pivot about a pivot point 15*b*. The drive roller 12 and the withdrawal roller 13 can be synchronously driven with the same peripheral speed.

A suction tube 14 is rotatably supported at a pivot point 14*a*, so that a suction nozzle 14*b* thereof can swing along a circular arc 14*c*.

A thread puller 16 can pivot about a pivot point 16*a*. The thread puller has a thread gripper 16*b* which describes a circular arc 16*c* as the thread puller 16 is moved.

A thread separating or severing location in the form of a grinding disc 20 serves for treating the thread which is to be conducted back, as will be described below. Furthermore, a thread regulator 17 is provided, which can swing about a pivot joint 17*a*. The regulator is rotatably fastened at a pivot point 18*a* of a thread lifter 18. The thread lifter 18 can be controlled by a connecting rod or coupling 19 which articulates with the lifter. The connecting rod 19 is connected with the housing of the spinning starting or thread joining device 10 at a pivot point 19*a*. A clamp 17*b* of the thread regulator 17 can swing along a circular arc 17*c*.

Below the roller 13 is a throw off device 21, which can slide vertically in the plane of the drawing. The throw off device 21 serves to throw the thread from the withdrawal roller 13 onto a roller 23 of a thread transfer element 22, at a given time. The thread transfer element 22 can swing about a rotation point 22*a*. The thread transfer element includes a lever 22*b*, to which one end of a retraction spring 24 is attached. The other end of retraction spring 24 is linked to an adjustment screw 25. The force of the spring can be adjusted with the adjustment screw 25. The roller 23 of the thread transfer element 22 can swing along a circular arc 23*a*. If the thread transfer element 22 swings into the other end position, the effective lever arm of the lever 22*b* changes, so that the effect of the retraction spring 24 on the thread transfer element 22 is reduced. When the thread transfer element has reached its other end position, an additional lever 22*c* thereof operates a switch 26.

A stop pin 26*a* prevents the thread transfer element 22 from swinging too far back, due to the action of the retraction spring 24. The pivot point 22*a* is inclined, so that the roller 23 can swing on the arc 23*a* to the forward end of the bobbin 8.

FIG. 1 shows the location of all of the parts during the undisturbed spinning operation. Sliver 2*b* is conducted to the spinning element 1*a* from a can 2*a*. The thread 2 is generated in the rotor 1*b*, is conducted through a tube 28, and pulled by the withdrawal device 3, 4 with constant speed. A lifter 27, which can swing about a point 27*a*, serves for lifting the clamping roller 4. The clamping roller can swing around a point 4*b* and is shown in its rest position. During an interruption of the spinning operation which requires a new start of the spinning or a thread joining, the same situation exists with the difference that the thread 2 is not present and the thread end is disposed on the bobbin 8. The feed of sliver 2*b* is blocked.

Upon a command to start the spinning or thread joining operation, the drive arm 11 swings toward the bobbin 8. Subsequently, the suction arm 14 also begins to swing toward the bobbin 8. When the drive arm 11 reaches the bobbin, its drive roller 12 starts to rotate backward. The roller 12 thereby lifts the bobbin 8 from the winding roller 7 and rotates it in a direction opposite the winding direction.

Figure 2:
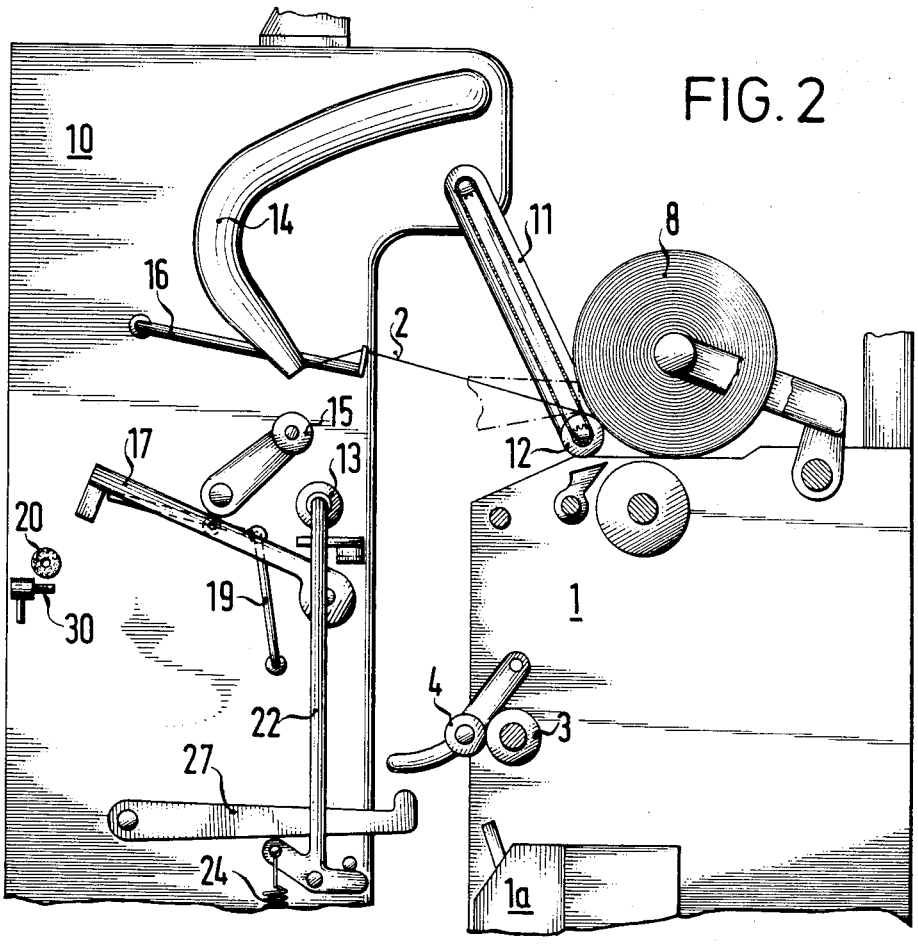
FIGS. 2 to 4 are fragmentary, side-elevational views of the device of FIG. 1 at different points in time during starting of the spinning or thread joining.

At the same time, the withdrawal roller 13 also starts to rotate in reverse. Meanwhile, the suction arm 14 has approached the bobbin 8 far enough, so that the suction nozzle 14*b* is positioned close to the surface of the bobbin. The thread is therefore sought out, located and sucked-up by the suction nozzle 14*b*. When this is accomplished, the suction arm 14 swings back again and takes along the thread 2, as shown in FIG. 2. At the same point in time, the drive roller 12 and the withdrawal roller 13 are stopped. Up to this point, the withdrawal roller 13 has not touched the thread, and was only running because it is turned on and off together with drive roller 12.

Figure 3:
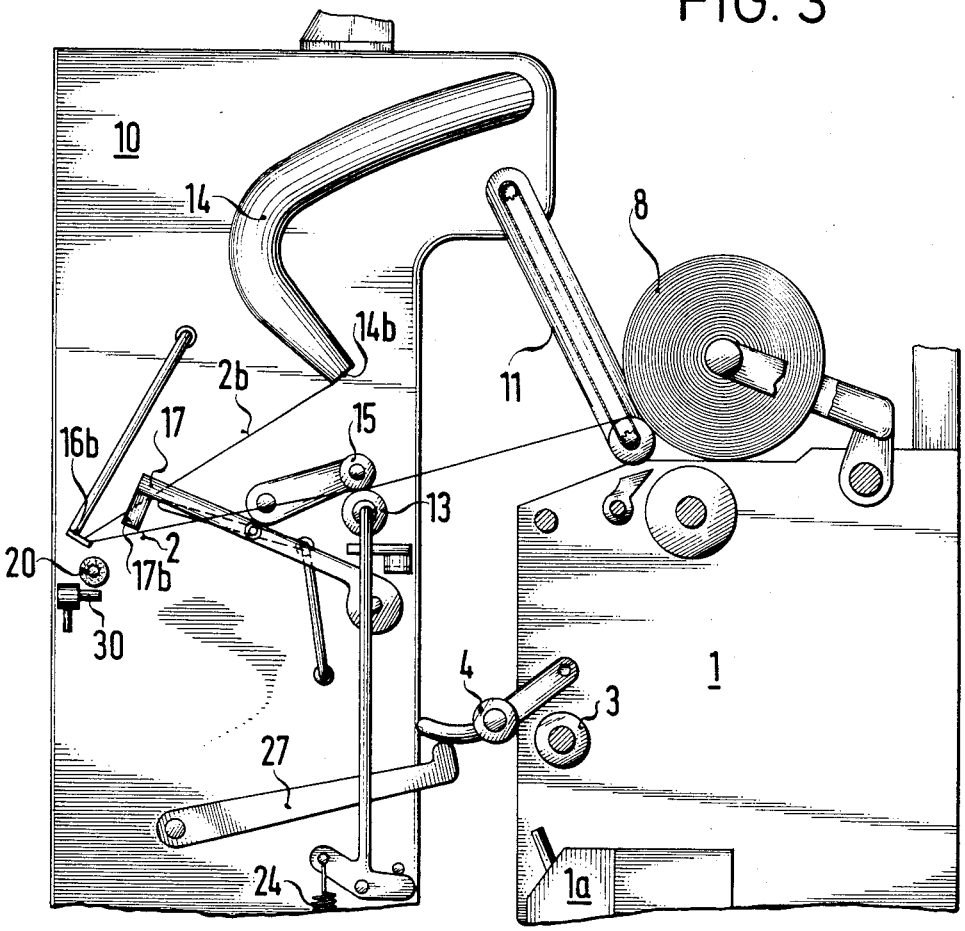
Figure 4:
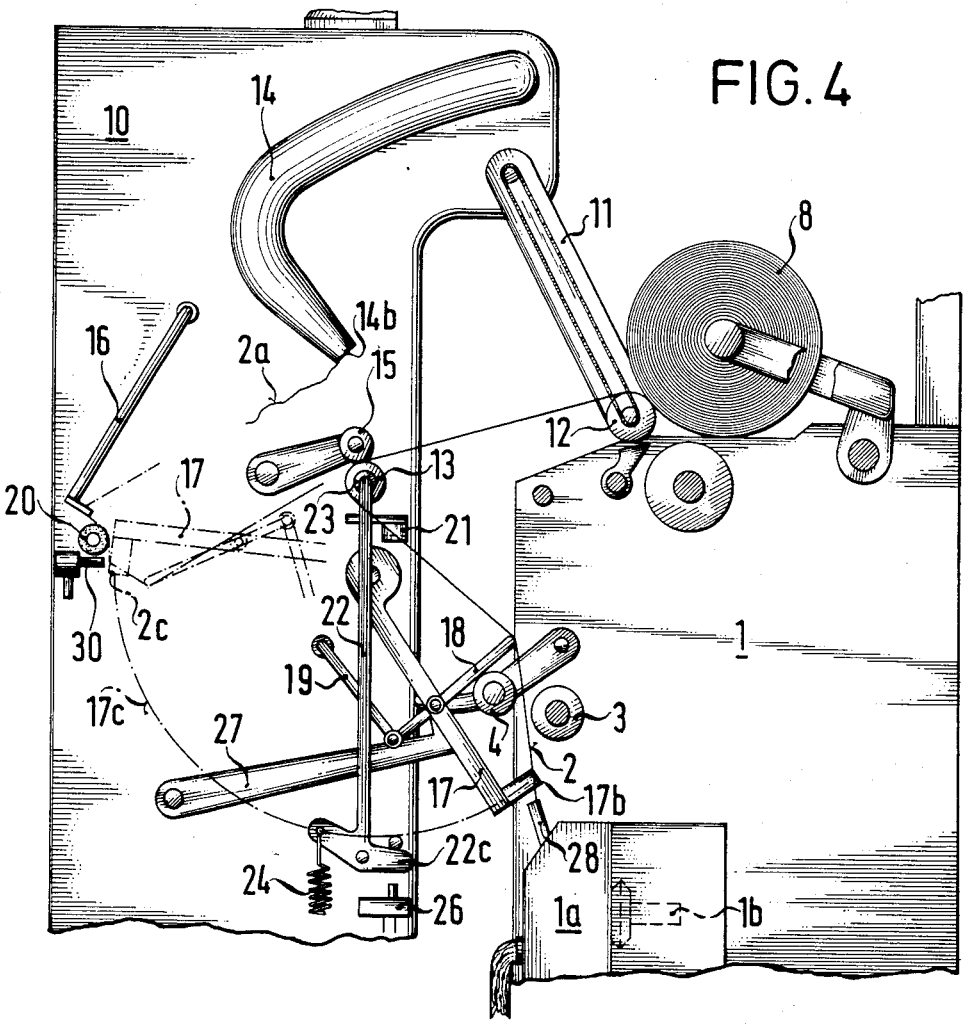

The thread puller 16 then swings upward, grabs the thread 2, swings back again, and forms the thread loop shown in FIG. 3. In this position, the thread runs from the bobbin 8, between the clamping roller 15 and the withdrawal roller 13 of the thread withdrawal device and to the thread gripper 16*b*. From there, the thread end 2*b* extends into the suction nozzle 14*b*. The clamping roller 15 then swings toward the roller 13, and the thread regulator 17 is set in motion. At the same time the clamping roller 4 is lifted also from the withdrawal roller 3 by the lifter 27, as shown in FIG. 3. The thread 2 is subsequently clamped between the withdrawal roller 13 which is not moving yet and the clamping roller 15. The thread withdrawal device 3, 4 of the OE-spinning device is now completely opened. Meanwhile, the thread regulator 17 is moved downward by a short distance, which is far enough to place the clamp 17*b* in front of the grinding disc 20. The grinding disc 20 severs the thread and a thread end 2*c* which is thus created as shown in FIG. 4, is immediately sucked into an untwisting nozzle 30. The untwisting nozzle 30 is disposed directly under the grinding disc 20. The thread end 2*c* is prepared by the untwisting nozzle 30 for the starting of the spinning or thread joining by untwisting the twist of the thread and by loosening the fibers; this happens before the thread regulator moves further down. The old thread end 2*a* is sucked away and removed by the suction nozzle 14*b*.

The drive roller 12 and the withdrawal roller 13 are then shifted into slow reverse rotation. At the same time, the thread-regulator 17 begins to swing further downward along the circular path 17*c*. Subsequently, the clamp or holder 17*b* of the thread regulator 17 is disposed in front of the opening of the tube 28 of the spinning unit 1*a*, as shown in FIG. 4. The thread lifter 18 which is controlled by the connecting rod 19 has taken a transverse position with respect to the thread regulator 17, and has therefore inserted the thread 2 into the opened thread withdrawal device 3, 4 of the spinning unit. The clamp 17*b* then opens. At the same moment, the end of the thread is sucked into the tube 28 of the spinning device 1*a*. Simultaneously, the drive roller 12 and the withdrawal roller 13 are shifted to a faster reverse rotation.

As soon as the thread end has almost reached the rotor groove of the rotor 1*b*, the drive roller 12 and the withdrawal roller 13 are stopped, and thereafter they immediately feed the remaining thread portion back into the rotor 1*b* in a very fast reverse rotation, so that the actual starting of the spinning operation or thread joining is effected.

The rotational direction of the drive roller 12 and the withdrawal roller 13 is subsequently changed and their velocity is increased with rapid acceleration up to the predetermined speed of the thread withdrawal during normal spinning operation. Meanwhile, the thread regulator 17 begins to swing back without the thread. The operational speed of withdrawing or pulling the thread is then reached, i.e. the withdrawal rollers 3 and 13 have the same peripheral speed. (The roller 3 continuously rotates with the normal thread velocity).

The lifter 27 is then taken back again, so that the clamping roller 4 lies against the withdrawal roller 3. At this point, the thread 2 can be transferred to the thread guide 6. For this purpose, the clamping roller 15 is first lifted from the roller 13, and the throw off device 21 is set in motion. The throw off device 21 pushes the thread 2 laterally off the roller 13, so that it slides onto the roller 23 of the thread transfer element 22. When this is accomplished, the thread transfer element 22 begins to swing in a slanted direction toward the OE-spinning device 1. Simultaneously, the drive roller 12 and the withdrawal roller 13 are shifted to fast forward rotation. This is necessary to ensure that the bobbin 8 can accept the additional length of thread which was created by the swinging motion of the thread transfer element 22, with unchanged or slightly increased thread tension. Actually, the roller 13 has no function at this point, and only rotates freely because it is driven synchronously with the drive roller 12, for reasons of simplicity. In this case, the swinging motion of the thread transfer element 22 is carried out by the effect of the thread tension against the force of the adjustable retraction spring 24. The retraction spring 24 is mounted in such a way that the force component acting in the direction of deflection becomes smaller with increasing deflection of the thread transfer element 22. This is advantageous because the wrap around angle of the thread and therefore the effective force components of the thread tension as well, also become smaller with increasing deflection. In the end position of the thread transfer element 22, the lever 22*c* operates the switch 26. The switch 26 again switches the drive roller 12 and the roller 13 back to the normal thread withdrawal speed. Since the thread transfer element 22 brings the thread 2 under the end of the spool at a slant, the thread first slides laterally off the drive roller 12, is conducted by the thread guide 6, and is pulled to the side from the roller 23 of the thread transfer element 22.

After the thread transfer is completed, the thread transfer element 22 again swings to its starting position due to the action of the retraction spring 24. Subsequently, the drive arm 11 also begins to swing back. During the motion of the drive arm 11, after the bobbin 8 again lies on the winding roller 7, the drive roller 12 and the withdrawal roller 13 are turned off. When the drive arm 11 has again reached its rest position according to FIG. 1, the automatic spinning starting or thread joining operation is finished.

The programming mechanism used for coordinating the various operations is housed in the spinning starting or thread joining device 10, and is not further illustrated. For instance, a conventionally operating electromechanical programming device may be used which operates with cam discs.

Instead of the grinding disc 20, a different thread cutting device such as controlled scissors, may be used. In an alternate version, the spinning element 1*a* could be formed of two friction drums instead of a rotor, so that in this case the OE-spinning device would be a friction spinning device.

Figure 5:
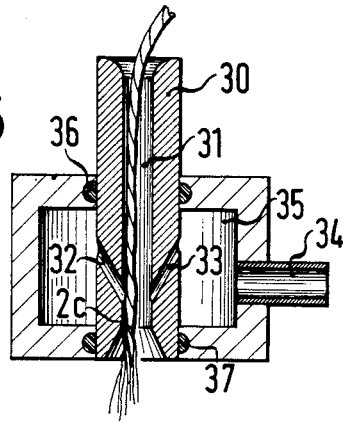
FIG. 5 is a longitudinal-sectional view of an untwisting nozzle.
Figure 6:
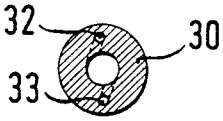
FIG. 6 is a cross-sectional view of the untwisting nozzle shown in FIG. 5.

The untwisting nozzle 30 shown in FIGS. 5 and 6, has a thread channel 31 through which a gas can flow and which sucks in, accepts and temporarily holds the thread end 2*c*. Two injection channels 32 and 33 terminate in the thread channel 31 for generating the gas flow. This is done with a tangential direction component, as shown in FIG. 6 in particular. Compressed air flows from a pipe 34 which is attached to a hose for compressed air, into a distributor chamber 35, for instance, and from there through the injection channels 32, 33. O-rings 36 and 37 seal the distributor chamber 35 from the untwisting nozzle 30.

Figure 7:
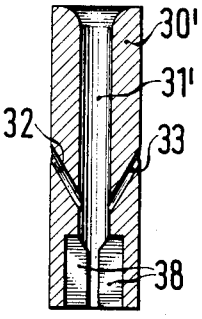
FIG. 7 is a longitudinal-sectional view of another untwisting nozzle.

The untwisting nozzle 30' according to FIG. 7 differs from the untwisting nozzle 30 according to FIGS. 5 and 6 only by the feature that it is improved with bearing or impact ledges 38 for the violently moving thread end. The bearing ledges 38 are constructed in the form of ribs which project into the thread channel 31'.

The invention is not limited to the illustrated and described embodiments which were used as examples. For instance, it could be advantageous to supply the injection air in pressure surges. For this purpose, a pressure surge generator in the form of a valve which opens and closes in rapid succession, could be used.

The foregoing is a description corresponding in substance to German Application No. P 34 27 356.5, dated July 25, 1984, the International priority of which is being claimed for the instant application, and which is hereby made part of this application.

I claim:

1. Method for starting the spinning of a thread in an OE-spinning device, which comprises bringing a thread end to a compressed gas current with a thread regulator before starting spinning, sucking in and holding the thread end and loosening fibers of the thread end with the compressed gas current for a limited period of time, subsequently removing the thread end from the compressed gas current and conducting the thread end to a spinning element with the thread regulator, collecting spinning fibers at the spinning element, and subsequently applying the spinning fibers to the thread end.

2. Method according to claim 1, which comprises rotating the gas current.

3. Method according to claim 1, which comprises adding turbulence to the gas current.

4. Device for starting the spinning of a thread in an OE-spinning device having at least one spinning element for collecting spinning fibers and applying the spinning fibers to a thread end, comprising an untwisting nozzle having a thread channel, a thread regulator for holding a thread end, means for conducting the thread regulator with the thread end to the thread channel before starting spinning, means for sucking in and temporarily holding the thread end and loosening fibers of the thread end in the thread channel with a compressed gas current for a limited period of time before starting spinning, and means for subsequently removing the thread regulator with the thread end from the thread channel and conducting the thread regulator with the thread end to the spinning element.

5. Device according to claim 4, wherein said sucking, holding and loosening means include at least one compressed gas conduction injection channel terminating in said thread channel.

6. Device according to claim 5, wherein said injection channel terminates in said thread channel with a tangentially directed component.

7. Device according to claim 4, wherein said untwisting nozzle includes an outflow end having bearing surfaces for spinning the thread end.

8. Device according to claim 7, wherein said bearing surfaces are ribs extending into said thread channel.

9. Device according to claim 4, including a movable spinning starting device on which said untwisting device is disposed.

10. Device according to claim 4, wherein said thread regulator is movable in a given operating range from a thread severing location to the spinning element, said untwisting nozzle being disposed within said given operating range.

* * * * *